US006134860A

United States Patent [19]

Pagano et al.

[11] Patent Number: 6,134,860

[45] Date of Patent: Oct. 24, 2000

[54] BIDIMENSIONAL PREFABRICATION SYSTEM FOR CIVIL AND INDUSTRIAL BUILDINGS MADE UP OF MODULAR EQUIPPABLE WALLS HAVING A WOOD LOAD BEARING STRUCTURE RELEVANT FIXTURES FOR THE REALIZATION OF THE PREFABRICATION COMPONENTS, AND PREFABRICATION COMPONENTS

[75] Inventors: Enzo Pagano; Andrea Paco Pagano, both of Oricola, Italy

[73] Assignee: Pagano Engineering S.r.l., Oricola, Italy

[21] Appl. No.: 09/000,156

[22] PCT Filed: Jul. 26, 1996

[86] PCT No.: PCT/IT96/00153

§ 371 Date: Jan. 27, 1998

§ 102(e) Date: Jan. 27, 1998

[87] PCT Pub. No.: WO97/05341

PCT Pub. Date: Feb. 13, 1997

[30] Foreign Application Priority Data

| | | | |
|---|---|---|---|
| Jul. 28, 1995 | [IT] | Italy | RM.95-A/527 |
| Jul. 28, 1995 | [IT] | Italy | RM.95-A/528 |
| Jul. 28, 1995 | [IT] | Italy | RM.95-A/529 |
| Jul. 28, 1995 | [IT] | Italy | RM.95-A/530 |

[51] Int. Cl.[7] ..... E04B 1/00

[52] U.S. Cl. ..... 52/745.1; 52/749.1

[58] Field of Search ..... 52/745.1, 578, 52/122.1, 506.01, 461, 579, 581, 747.1, DIG. 1, 749.1

[56] References Cited

U.S. PATENT DOCUMENTS

| | | |
|---|---|---|
| 2,626,643 | 1/1953 | Kantzler . |
| 3,699,622 | 10/1972 | Frydenberg . |
| 4,165,591 | 8/1979 | Fitzgibbon . |
| 4,280,307 | 7/1981 | Griffin . |

FOREIGN PATENT DOCUMENTS

| | | |
|---|---|---|
| 2544408 | 10/1984 | France . |
| 2693148 | 1/1994 | France . |

*Primary Examiner*—Beth A. Stephan
*Attorney, Agent, or Firm*—Smith, Gambrell & Russell, LLP

[57] ABSTRACT

The invention relates to a bidimensional prefabrication system for civil and industrial buildings made up of modular equippable walls having a wood load bearing structure. The invention also relates to fixtures for the realization of the prefabricated components, and particularly to a multi-equipped bed frame, and to a joint element. Moreover, the invention concerns prefabrication components.

33 Claims, 8 Drawing Sheets

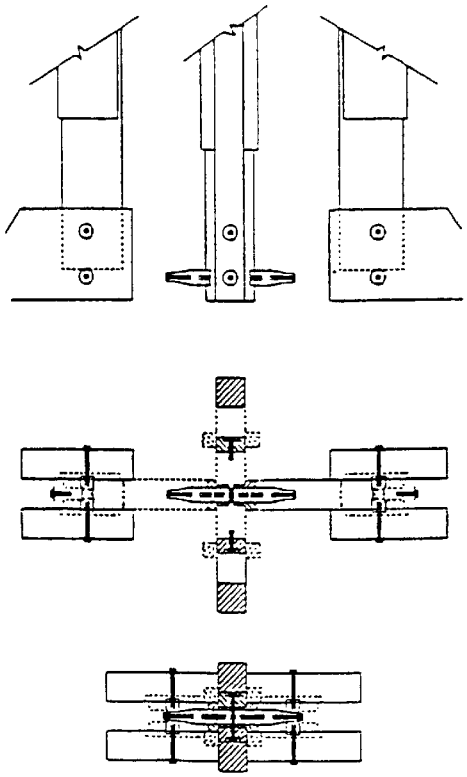
FIG. 11
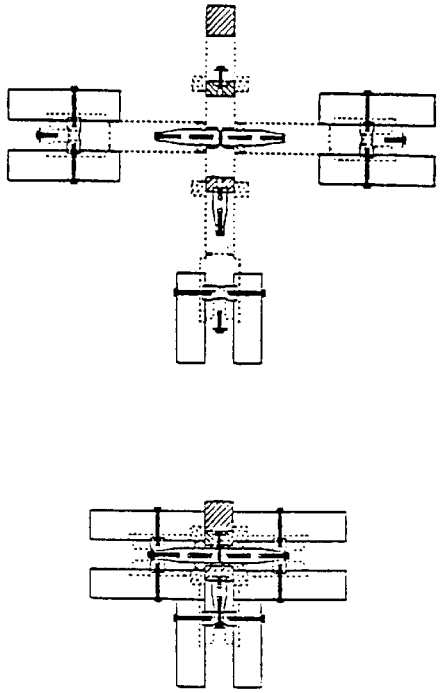
FIG. 12
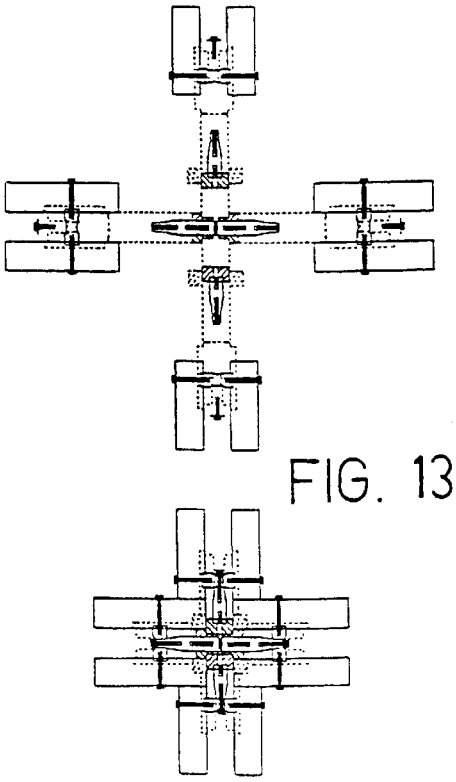
FIG. 13
FIG. 14
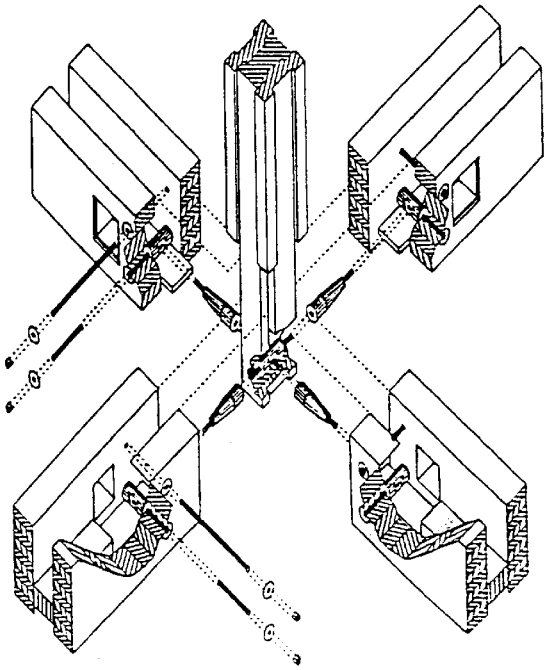

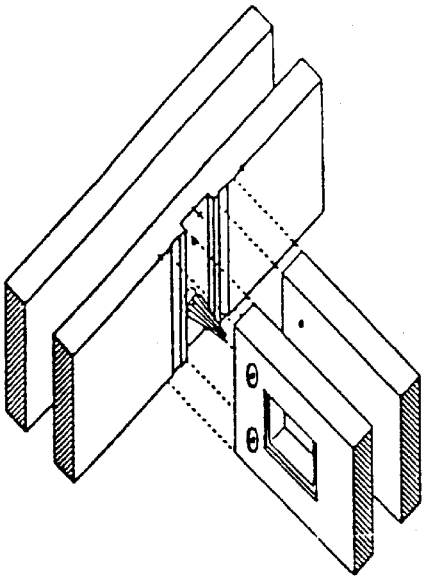
FIG. 15
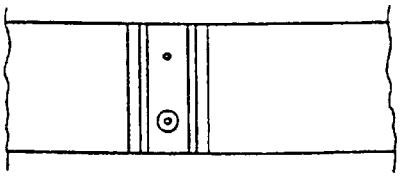
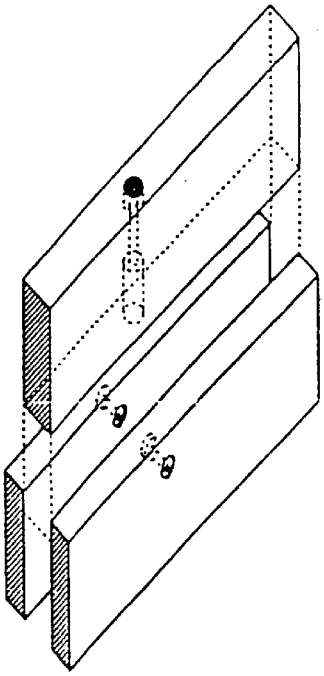
FIG. 16
FIG. 17
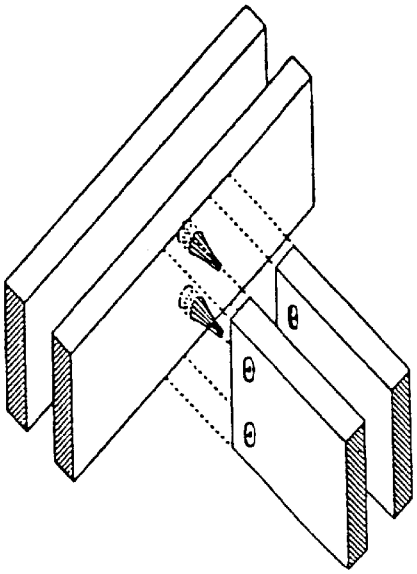

BIDIMENSIONAL PREFABRICATION SYSTEM FOR CIVIL AND INDUSTRIAL BUILDINGS MADE UP OF MODULAR EQUIPPABLE WALLS HAVING A WOOD LOAD BEARING STRUCTURE RELEVANT FIXTURES FOR THE REALIZATION OF THE PREFABRICATION COMPONENTS, AND PREFABRICATION COMPONENTS

The present invention relates to a bidimensional prefabrication system having finished wall modules.

Particularly, the present invention concerns a prefabrication system which, even industrializing the whole production cycle, allows the maintenance of the maximum compositive-intrinsic and expressive freedom under the architectural point of view.

This system is based on the aggregation of modular wall elements having the structural parts comprised of wood and conceived in such a way to be completely assembled by plugging, finishing and plants before the assembly step in the field; this allows the elimination of the building process in situ and the need for having skilled labor, and at the same time, dramatically reduces manufacturing and mounting times, with all the above resulting in a reduction of costs strictly connected with the use of handicraft labor.

The equippable modular walls guarantee the maintenance of the full freedom of architectural design expression, since it is possible to assemble them by an exhaustive range of standard or non-standard integrable modular components, satisfying all the usual architectural needs in the modern design.

Further, the present invention concerns a multi - equipped bed frame with an adjustable positioning.

More specifically, the invention concerns a frame of the above kind which allows the assembly of a group of standard components prepared according to the design directly with the factory without the need for skilled labor and technical time drastically reduced, resulting in a single assembly (equippable modular wall), structural sub-assembly of the global system, provided with structural parts, pluggings, finishings and plants.

The solution suggested according to the present invention is based upon the principle of the guided fixed joint and tightening by pressing of simple intelligent components, suitably conceived to be connected in a simple, automatic and flexible way.

The present invention also relates to a joint element for an easy composite assembling.

More specifically, the invention relates to a joint element suitable to join more than one structural component, thus simplifying and helping the assembling and tightening steps in the field.

Finally, the present invention relates to a complete equippable modular wall.

More particularly, the invention relates to a wall of the above kind, preferably having a wood support structure, and that can be arranged in any kind of structural aesthetic combination, always relying upon a double track main structure.

As it is well known, the known prefabrication systems can be divided into two main classes: on one side are the global prefabrication systems for creation of standard inhabited modules for use in the construction of civil and industrial buildings, and characterized by a flat and constant qualitative property of the aesthetic, structural and distributive aspect. Many modules are industrially produced in a rigid way such that it is not possible to go out of the severe design and manufacturing schematization and there is also involved very high costs and the need for highly skilled labor for the integration of non-standard components.

On the other side are the systems providing a specialized prefabrication of the single components of single steps of the manufacturing process, like, for example, the prefabrication of the sole structural part, which delegates to the assembling and finishing step on the field the realization of the main part of the building, being thus assimilable to handicraft products insofar as the specialization, costs and realization time are concerned.

It is known that both the global prefabrication and the specialized prefabrication systems are in most cases of very low quality because of the need to reduce the costs of the materials employed, said costs becoming very high for all the non-standard parts of the buildings, and for the mounting and finishing steps on the field.

A further disadvantage of the known prefabrication systems, mainly for the civil buildings, is due to the low flexibility and repeatability of the structure or of the elements comprising the same, with the consequent negative influence either on the landscape or on the users of the same building who have no space to introduce personalization elements during the design step of the building because the system is being strictly conditioned by the prefabricated components that are not developed in a sufficient way.

Instead, as to the known wood prefabrication systems, there are two main types, the first type comprises systems by which it is possible to produce buildings, requiring a great deal of time, and at very high costs, such that it is necessary to complete the wood structural part, the plugging and the plants directly on the field by using skilled labor. The second type comprises systems allowing to realize very easy or simplistic products that are not finished, is comprised of elementary room units that can be integrated with each other with some difficulty, and that lack the appropriate features.

The choice of wood as material for the production of prefabricated structures, if it is not suitably treated, is not competitive with other traditional construction materials, since it does not guarantee the maintenance during the time of the performance features initially designed.

U.S. Pat. No. 2,626,643 describes an apparatus for producing prefabricated building walls whereby two side walls or panels of a wooden building, such as a dwelling, may be fabricated simultaneously upon the apparatus and in a horizontal position.

U.S. Pat. No. 3,699,622 concerns a method and an apparatus for making wall panels using pre-formed sub-assemblies having centrally positioned locators thereon. The plate members which are provided with locating matches, are carried to a mailing station.

It is therefore well evidence the need for introducing into the field of the building industrialization technology for civil and industrial buildings, a bidimensional prefabrication system which is more flexible and satisfies different design needs, which is able to overcome the drawbacks of the known systems, by industrializing the whole manufacturing process of all the elements of the building, in order to produce by serial cycles different houses having a high qualitative coefficient.

More particularly, the bidimensional prefabrication system according to the present invention aims to replace a specialized system by a global prefabrication system, provided that this solution is not limited to the preparation of the structural elements but provides, during the industrialized production step, also the creation and the preparation of modular element having pluggings, plants and finishings; all the above is possible due to the use of complete modular elements; as far as the elements are concerned, the reaching of essential shapes and proportions is due to a rationalized experimental analysis, aiming to the maximum optimization and integration of a single component, within the structural system, as well as the capability to be able to easily assemble floors and roofs integrable with said complete modular elements, thus avoiding the need for skilled labor, and at the same time reducing the mounting time and the relevant costs.

In order to satisfy such need, it is proposed according to the invention a prefabrication system providing a complete manufacturing cycle of component elements for producing complete wall modules that are capable of performing the structural and plugging function and that can be provided with finishings and plants so that they can be integrated with all the other structural floor and roof elements necessary for the construction of the building.

The choice of making the wall modular elements complete with plugging, finishings and plants that can be mounted and connected with the corresponding elements and the floor structures by a guided connection fixed joint system and coupling joints is based on a precise structural choice: the building is schematized as a global box-type system since either said wall elements or the roofs behave like a shear wall able to guarantee the seismic safety provided by the rules. The connections are ensured by hinge joints that are easily mounted and highly resistant and provided with adjustment and control means.

The structural choice upon which the present invention is based further provides that the floor elements are self-bearing sandwich panels acting on rigid beams along the horizontal plane and acting as box-type beams along a plane parallel with respect to the ground.

Finally, the element making it possible for the above mentioned structural choices and the possibility of realizing the equippable wall modules in an industrial manufacturing process, making them suitable each time to the different design features, is the choice of making all the structural components, like pillars, main inner beams and floor, secondary and tertiary arches by conifer lamellar wood glued by resorcinol resins with very high pressures and impregnated by vacuum autoclave.

In view of the particular features of static strength, lightness and ease of mounting of the lamellar wood, all the structural elements have received further functions besides the structural function, such as those of housing the fixing tools of the various elements making the wall during the assembling step, of housing of the peripheral connections of the technical plants and of ease of integration with the other structural elements.

More particularly, in order to realize said integration with the other structural elements, it is proposed according to the invention to prepare the end and eventually intermediate surfaces of each component with a particular shaping made to allow easy insertion with the mating shaping of the adjacent elements; housing and favoring the preparation of the fixing elements; defining the housing seats for the passage of the plant connections.

The basis for the structural choice characteristic of the prefabrication system according to the invention is an industrialization process always more sophisticated during the execution of the basic components, so as to reduce the factory manufacturing costs and to be able to use an assembling method that can be executed by a small number of unskilled working units and to reduced fitting time in the field.

This feature of the industrial realization system for the basic components provides a design step during which the whole design is analyzed by computers as to its feasibility and components, and automatically divided into single walls. For each one of said walls the single elements and the relevant nodes are individuated, designed and decomposed.

As to the bed frame here described, the machinery according to the present invention has been realized on the basis of some main points:

- the frame is based on a size fitting of the relevant parts in order to allow the production of all the possible size variations for the structural parts (modular bidimensional walls), without the need of divisions or limitation;
- it provides an assembly pre-established guide, working as a guide forced to the proper insertion of the standard components without the need of any mental elaboration, but only a rational and elementary pre-established sequence in order to guarantee a perfect assembly. It absolutely does not jeopardize the compositive freedom of the system, since it is included within a step of the general manufacturing cycle, wherein all the architectural-functional needs have already been interpreted and translated. An essential contribution is obtained by the standard components providing particular surface conformations, further facilitating the above mentioned steps;
- the frame according to the invention is able to normalize the tolerances in order to allow, in case offsets occur due to outer events, a new stabilization of the proper proportions and relevant positions among the single components in such a way to not jeopardize the following assembly steps by maintaining the mistake;
- the frame according to the invention constitutes an instrument supporting the repeated needs of the worker since during the assembling step all the main actions performed by the skilled workers are realized in a fast way due to the rationalization and to the ergonomic determination of the containers and of the fixing elements for the very few tools necessary for the tightening of the single components;
- it allows a rationalized motion within the manufacturing cycle since thanks to the help of oleodynamic pneumatic pistons, the working plans can take different positions between 0° and 90°, in order to allow the integration of two different steps: the first assembly step in a horizontal position where the reduced height speeds up and facilitates the steps; the second one is the discharge step with the assembled unitary element already in a vertical position, by grasping and transfer to the next manufacturing steps.

Further, the invention suggests a joint element made up of two main components, preferably realized by galvanized zinc steel, i.e., the insertion pin and the housing cylinder. The components slide one within the other, and comprise a series of complementary elements to form a complete blocking system.

The particular kind of tightening gives to two basic components the static feature similar to the one of a hinge, thus guaranteeing the complete respect of the degrees of freedom in the space for the assembled bodies, thus strengthening the capability of absorbing the high strength of the tension stresses.

The rapidity and the ease of mounting are characterized by the fact that the sole operation needed to make the joint as a single component is the screwing of the bolt, said screwing dragging the two basic components according to a baricentric axis, thus bringing the mating shaped surfaces in contact, and thus forming a clamp blocking system.

Finally, an object of the invention is that of suggesting an equippable modular wall substantially comprising two perimetric tracts, within which multi-functional components are placed, which thanks to their particular morphologic conformation, allow the formation of an infinite series of compositions in order to guarantee a global design flexibility and a contemporaneous perfect execution of architectural products.

As it is well evidence, flexibility is a particularly interesting aspect, since within the design and formation of the wall two different elements can be individuated: the first one aimed to obtain an inner compositive elasticity (possibility of associating all the multi-functional elements in view of the technical-realizative needing, varying from the simple solution of the technical passages to the contemporaneous facilitation of the assembling steps by the factory); a second aimed to the extreme compositive aspect, i.e. the unlimited aggregative possibility obtained by the walls with respect to an immediate adaptability to aesthetic and functional needs which are periodically faced in any constructive design.

The feature that can be obtained by the solution according to the present invention allows the composition of any kind of wall always using the bearing track substantially made up of an upper beam and a lower beam, within which the different standard components are inserted.

In this way it is possible to obtain a dimensional development mainly according to the biggest direction, without any limitation under a functional point of view.

More particularly, it is a specific object of the present invention to provide a method for prefabricating civil and industrial buildings comprising complete equippable modular walls, having a lamellar wood bearing structure, characterized by a well defined and correlated procedural hierarchy comprising: a first step of examining the architectural design; a second step of transferring to computers and dividing the same into complete wall modular elements, and determining for each one of them the structural or non-structural components; a third step of dimensional reciprocal matching of said standard components to the design data determining the dimensions of all the structural components, finishings, accessories, plants, of their mutual positions and couplings; a fourth step of individuation of the kind of work necessary for each semifinished product; a fifth step of transferring said design data to the machines necessary to create said components; a sixth step of realization of said structural and non-structural components; a seventh step of assembling with the factory of said structural and non-structural components for the realization of finished multi-functional bidimensional, structural elements (equippable modular wall); an eighth step of transferring said bidimensional elements at the field; a ninth step of assembling said bidimensional elements and integrating the elements with the horizontal structural components; a tenth step of connecting the plants or equipment (power supply, ducts, etc.).

According to the present invention, said first step of examining the architectural design and the functional and architectural requests of the client, and said second step of transferring said design to a computer in order to make the scansion and the conversion of the design in single components, according to the parameters making the personalized library of the system and therefore the typology of the standard elements, permits the formation of any architectural typology connected to a suitably assembled set of standard elements.

Always according to the invention, the formation of any kind of architectural typology is based upon the possibility of dimensionally varying the standard elements individuated during the second step in order to adopt them to the design needs, as well as on the possibility of individuating the mutual positions of the components and of the joints so as to have all the design data for each element by which a correct work is possible.

Always according to the invention, the design data complete of any information are transferred to the machines to be used for the realization of the various components.

Said machines are provided with computer systems processing and transforming said data consequently operating the single parts of the same, so as to obtain finished pieces ready to be assembled.

According to the prefabrication system of the present invention, said multi wall function complex elements are divided in such a way to allow an easy transport to the field without jeopardizing the structural resistance of the same.

Always according to the invention, said ninth step of assembling at the field occurs by connection and following attaching of said modular walls in correspondence of the upper and lower joint element and contemporaneous finishing by the floor, and roof elements and connection of the different positions of the plant.

Further, it is a specific object of the present invention to provide a multi-equipped bed frame having an adjustable positioning comprising a base plane; a support frame, hinged to said base plane in such a way to be able to take with respect to said plane any orientation from horizontal to vertical, a longitudinal track element provided integral with said support frame; a courter-shape or start abutment provided at one end of said track element; a tool supporting element or castle; a movable transverse element for the sliding longitudinal adjustment along said track element; and a plurality of movable transverse elements for the transversal adjustment, movable along said track element.

Preferably, according to the invention, said support frame is movable by a hinge coupling with respect to said plane by electro-hydraulic pistons in such a way to allow the disappearance of the electro-hydraulic pistons.

Always according to the invention, said tool supporting element or castle can provide containers and electric and pneumatic connections with the tube winders.

Further, according to the invention, said movable transverse element for the longitudinal adjustment can be made up of a C shaped tridimensional frame, provided with two vertically adjustable horizontal electro-hydraulic movable cylinders, operated by a ratiomotor and slidable along opposite longitudinal sliding guides.

Furthermore, said movable transverse element for the longitudinal regulation can be provided with a control movable push-button.

Still according to the invention, said movable transverse elements for the transverse adjustment can be made up of equipped tubular elements sliding along said track element, that can be stopped in the desired position by a mechanical clamping.

Further, according to the invention, in the upper end of the tubular element a hydraulic piston can be mounted (a thrust between 200 and 2000 Kg), fixed by a support with a height adjustable counter-bracket and that can be mechanically blocked by a rack.

The number of movable transverse elements for the transversal adjustment is chosen in such a way to be sufficient to guarantee the mutual disposition of the distance between centers, a proper positioning of the components, so as to avoid that the distance between different resting points can interfere in any way (flexion stresses) with the proper positioning of the same.

Always according to the invention, in the lower end of the transverse element a support square is fixed, said square defining the guided housing for the insertion of the lower longitudinal components of the structure to be assembled; the same function is performed on the other end by a containment template for the upper longitudinal components of the structure to be assembled.

Still according to the invention, said track element comprises two steel channels connected to a reticular warping made up of slanting crossed tubes.

Another specific object of the present invention is to provide a joint element for the facilitated composite assembling comprising a substantially frusto-conical shaped insertion pin male element, provided with a central through hole, and a housing female element having a central through hole for the insertion of said male element and two threaded blind transverse holes.

Preferably, according to the invention, said male element and said female element are made up of galvanized zinc steel.

Further, according to the invention, said male element provides a blind transverse hole for the coupling of a tightening tool.

Always according to the invention, said male element provides a slightly tapered cylindrical front portion to facilitate the insertion within said central through hole of said female element.

Still according to the invention, the outer surface of said male element is completely smooth.

Said female element of the joint element according to the invention can provide on two sides with respect to the through central hole a surface cylindrical recess for the housing of a tightening element and a slot for facilitating the introduction of the male element, respectively.

Still according to the invention, a plate to be placed between the fixing element and the wall can be provided.

The joint element according to the invention allows to realize any kind of fixing by suitably combining its components with tightening and coupling elements.

Finally, it is an object of the present invention also to provide an equippable modular wall comprising an upper beam and a lower beam, each beam being comprised of a pair of longitudinal elements disposed parallel to each other, said double track structure comprised of the upper and the lower beam forming a double track structure for the introduction of vertical elements for the completion of the wall.

Further, according to the invention, said pair of longitudinal elements of said upper and lower beams are separated and kept parallel to each other by spacer elements.

Still according to the invention, said upper and lower beams are provided with passages for the cables and/or tubes, shunt boxes, etc.

Always according to the invention, said wall can be coupled with a further prosecution or corner wall by suitable coupling means.

Particularly, according to the invention, said vertical elements for the completion of the wall can be of any kind and structure, being only important that they are formed in such a way to be introduced in the track structure and fixed by suitable means.

The present invention will be now described, for illustrative but not limitative purposes, according to its preferred embodiments, with particular reference to the figures of the enclosed drawings, wherein:

FIG. 11 shows a fifth use of the joint element according to the invention;

FIG. 12 shows a sixth use of the joint element according to the invention;

Figure 6:
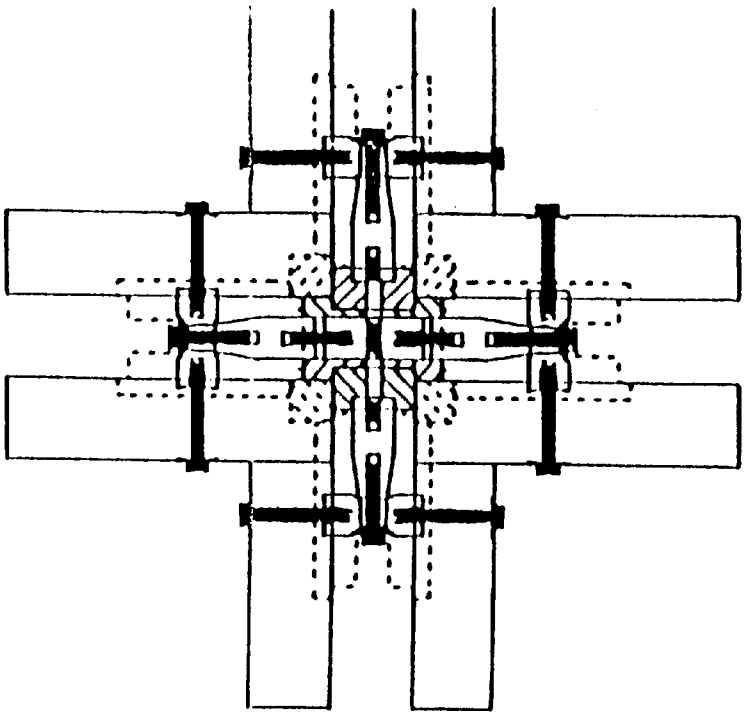
FIG. 6 shows a second use of the joint element according to the invention.
Figure 7:
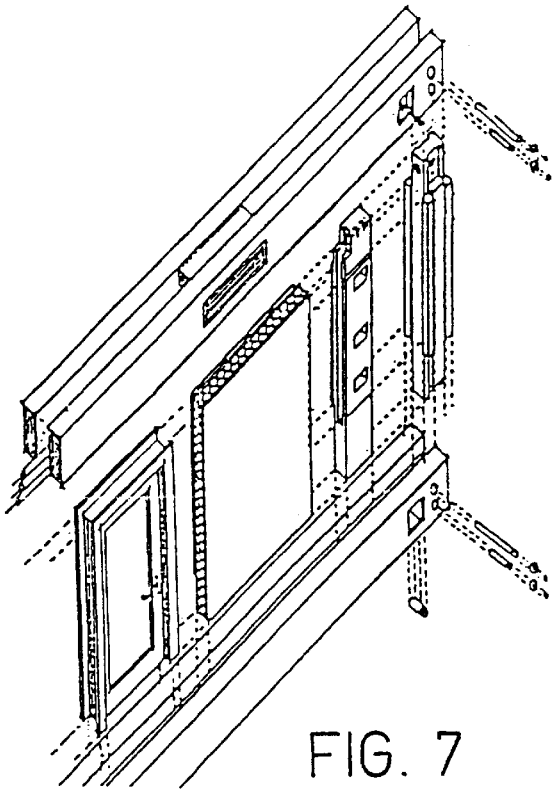
FIG. 7 shows an example of a wall on which the joint element according to the invention is used.
Figure 8:
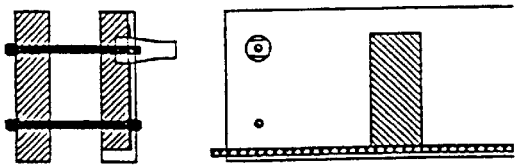
FIG. 8 shows a third use of the joint element according to the invention.
Figure 9:
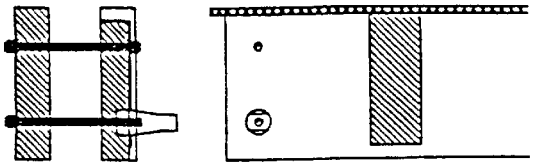
FIG. 9 shows a fourth use of the joint element according to the invention.
Figure 18:
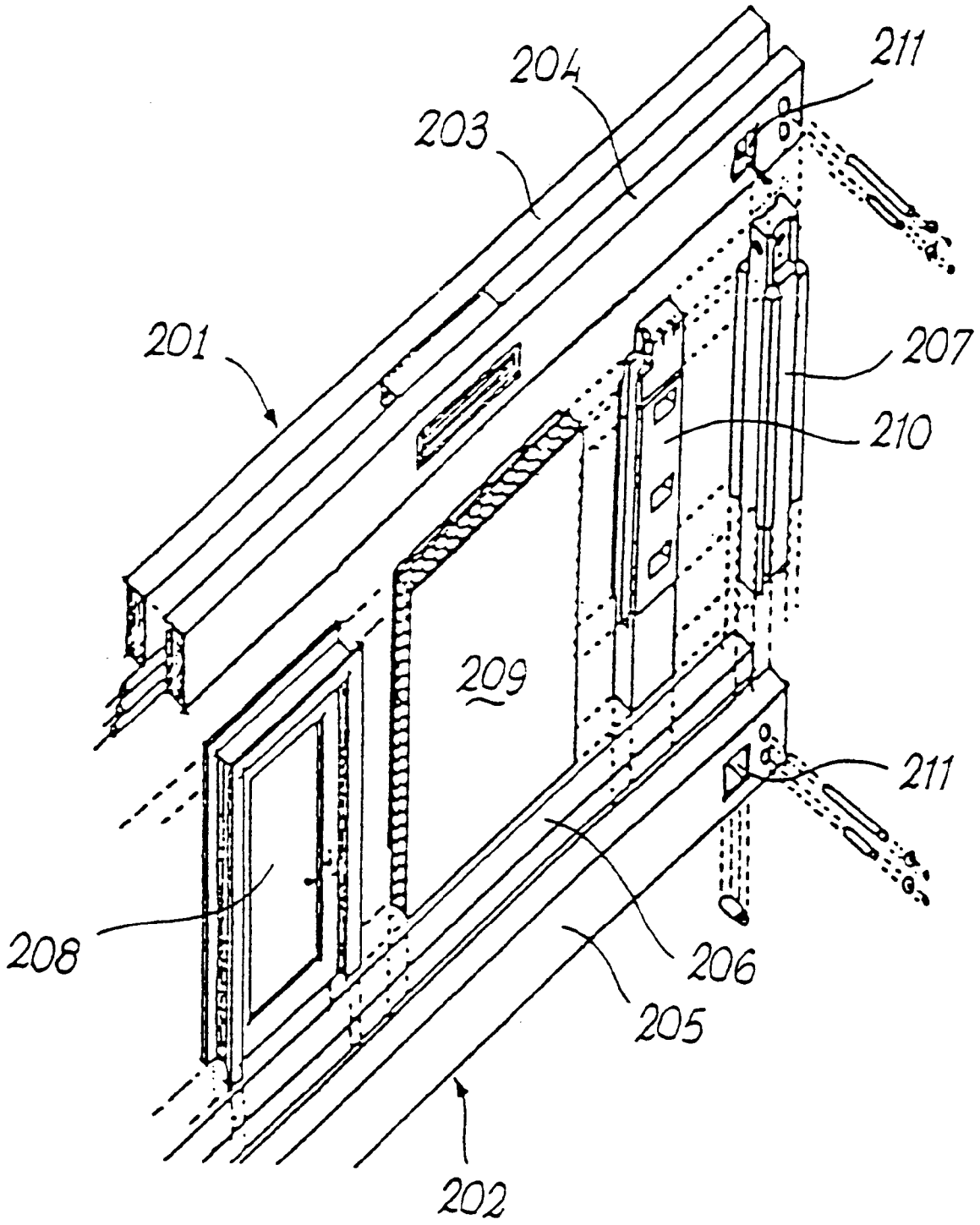

FIG. 13 particularly shows a use of the joint element according to FIG. 6;

FIG. 14 particularly shows a use of the joint element according to FIG. 7;

FIG. 15 shows a seventh use of the joint element according to the invention;

FIG. 16 shows an eighth use of the joint element according to the invention;

FIG. 17 shows a ninth use of the joint element according to the invention; and FIG. 18 shows an exploded perspective view of a wall according to the invention.

Referring to the following scheme, it can be noted that once the architectural design and the functional needs of the customer are examined (Step 1), the design is transferred to a CAD computer (Step 2) for the division into complete wall modular elements and for the adaptation of said bidimensional elements of the standard single components realizing the library of the system.

1 Architectural design and functional needs of the customer examination step.

2 Transfer of the architectural design to CAD computer and division of the same into complete wall modular elements individuating for each one of them the standard component elements forming the library of the system and individuation of the functions of each element.

3 Executive development of the architectural design by computerized procedures comprising the scanning of all the elements assembled in the building (beams, panels, coupling accessories, plants and hydraulic components) for the individuation of their positioning and the revelation of the juxtapositions/joints.

4 Individuation of the kind of working to be executed on each semifinished element in view of its function and to realize the couplings with adjacent elements.

5 Collection of the design data into suitable files and sending them to different automatic machines for the realization of the components according to the design data.

6 Realization of the different structural components.

7 Assembling of different components at the factory and creation of the completed bidimensional structural elements (structural function, plugging, finishing, plants) by positioning of the components of each bidimensional element ready for the transportation and the assembling at the field.

8 Transportation of said bidimensional components at the field.

9 Assembling at the field of the single structural parts by tightening the coupling points, the floors and the roofs.

10 Connection of the various components realizing the plants.

11 Testing

With the term "Standard components" it is to be understood according to the present invention components fixed as far as the structural or functional typology is concerned, but the dimensions, the positioning of the recesses that will house the fittings, and the position of nodes or like, of which can be varied.

In fact, during steps 3 and 4, the scanning of the single elements, of the features and of the dimensions of each one is performed, as well as of the kind of work necessary for each of them.

Under the graphic point of view, the result of the processing carried out during steps 2–4 is comprised of a series of executive graphic works containing all the necessary information for the working of the components; cut dimensions, position, shape and dimensioning of all the millings and drillings; the transmission of the above information occurs by files that will control the numeric control operative machines.

After step 5 of sending the above files containing all the design data relevant to the single elements to the relevant machines, the realization of the elements will occur (Step 6).

As already said, one of the moments characterizing the process according to the invention is that of forming complete modular walls (Step 7), provided also with plants, with the aid of the support and tightening device upon which the beams defining each wall are placed in correspondence of the upper and lower edges, and therefore, subsequently, the plugging elements, the plants and finishings, thus reaching the diversified realization of complete elements (wall module), only destined to be transported to the field to be assembled.

In view of the fact that according to the invention each modular wall already has all the elements provided by the design, the assembling of the elements in the field is very simple thus resulting in a great reduction in time and costs, the elimination of the need for skilled labor and requiring only the proper engagement of adjacent elements, the tightening of the junctions guaranteeing a proper alignment of the same parts and the connection of the plant parts provided on each wall.

It should be noted that according to the system described in the present invention, on the ground where the building should be realized, there is suitably arranged beforehand foundation structures, as well as the electric, the hydraulic and the water discharge plants, in such a way that at the end of the assembling and plant connection step (Steps 8 and 9) also the connection to the general networks and then the testing of the structure and of the same plants (Step 10).

Figure 1:
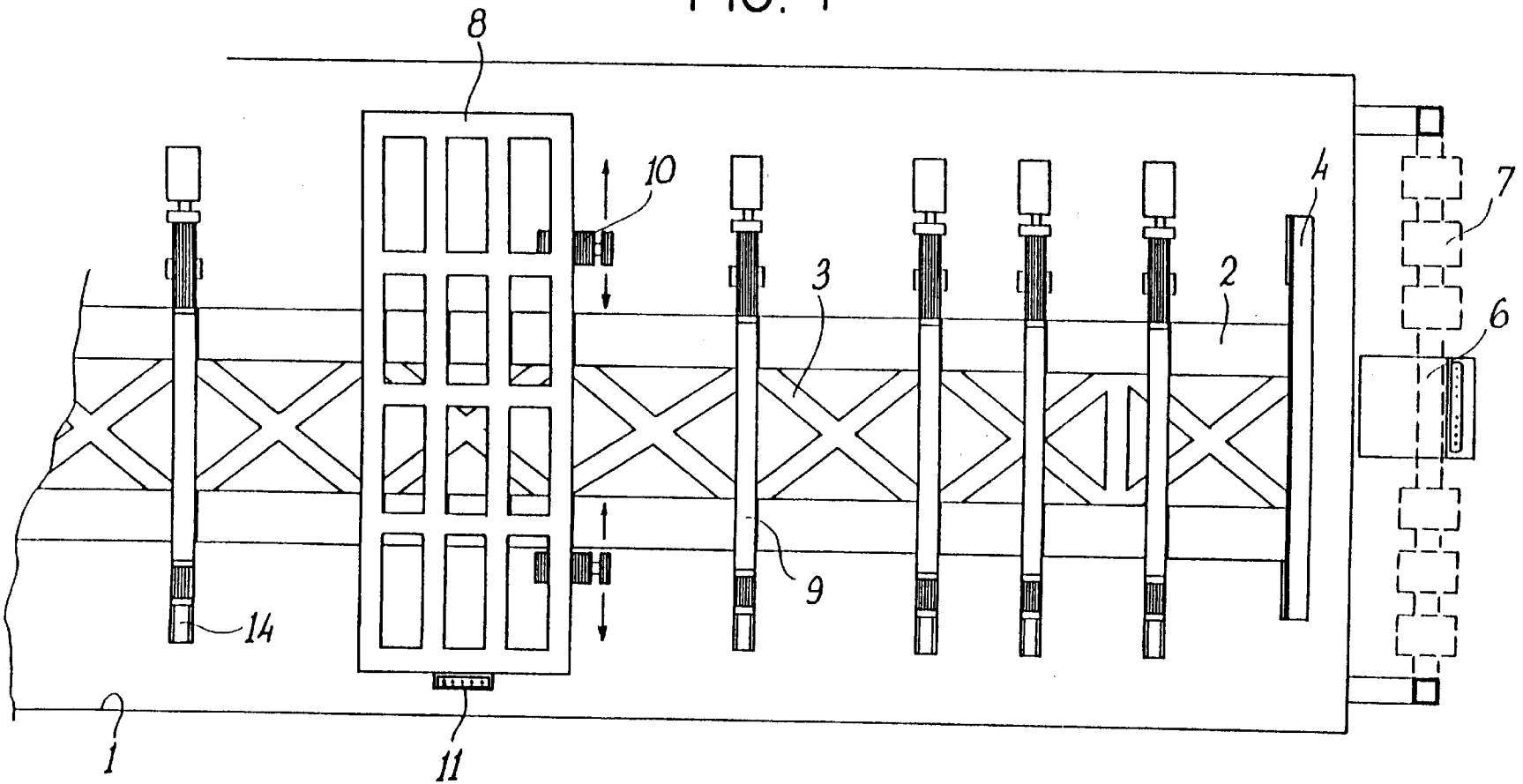
FIG. 1 is a plan schematic view of a bed frame according to the invention.
Figure 2:
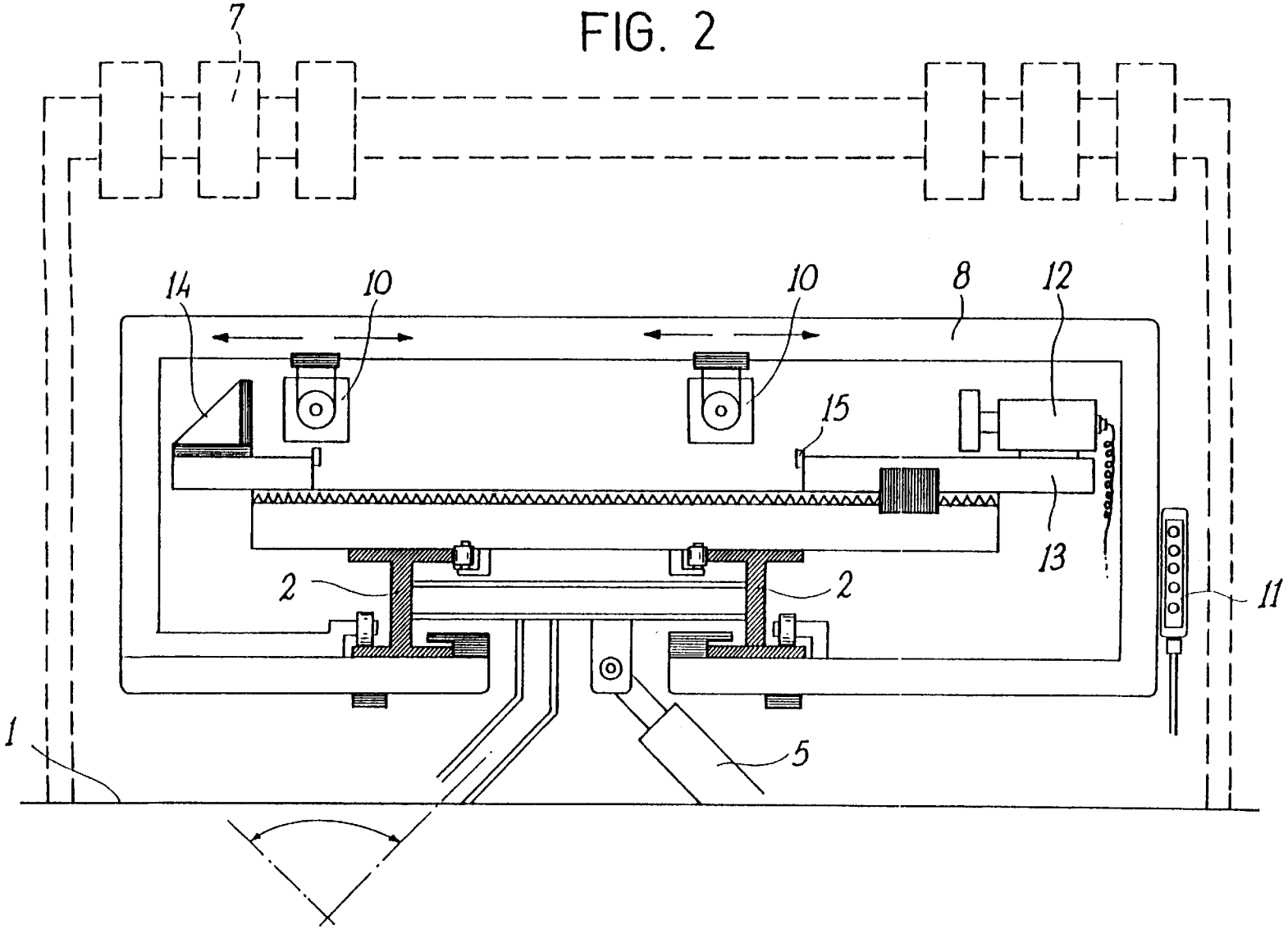
FIG. 2 is a front schematic view of the bed frame of FIG. 1.

Coming now to observe FIGS. 1 and 2, the bed frame according to the invention provides a base platform 1 upon which all the other components are provided.

The support frame is comprised of a track main structure 2 made up of two steel section bars which are integral by a reticulated transverse roof scaffolding 3 made up of stiffening slanting crossed tubular elements developed along the main dimension, upon which a series of multi-function blocking elements (that will be better described in the following) slide, said elements can be positioned in such a way to cover all the possible realizative problems.

Said track 2 is closed on one side by a counter-shape or start abutment 4, provided in order to automatically prepare (e.g., position) the structural components (now shown) placed at the beginning of the assembly step (lower and upper longitudinal members, angular component), according to an obliged offset that should create part of the hooking system of the complete modular wall element.

Pistons 5 are provided on the lower part of the support frame, preferably oleodynamic electro-hydraulic turnable disappearing pistons, which are electrically operated by the operators, and allow the rotation of the working plane from a horizontal to a vertical orientation, in order to facilitate at the end of the assembling step of the single components in the unitary assembly of the wall, the simple lifting and transfer to a following step in the realizative process.

The rotation occurs because of the hinges (not shown) provided on said platform 1, which rests on the ground, allowing to house within its thickness the necessary technical spaces for the return of the electro-hydraulic pistons 5 and to contemporaneously perform the resting anti-slipping floor function for the operators during those mounting steps with the working plane in a horizontal position.

In practice, all the general motion controls (except those that will be described in the following) are controlled by a hydraulic station provided on the outer perimeter of the platform 1, that can be easily maneuvered and inspected while staying on the ground.

Further, on said support frame a tool bearing or castle 7 is provided, said element 7 being provided close to the start abutment 4 in correspondence of that part of useful surface that is mainly used, made up of a series of containers and electric and pneumatic connections provided with ergonomically positioned winding machines for tube of a length up to 12 m, realizing the integrated housing in relation of the mounting needs for the used tools.

The above mentioned multi-functional blocking elements are made up of a longitudinal movable elements 8 and of transverse movable elements 9.

The longitudinal movable transverse 8 is made up of a tridimensional C-shaped frame, which can freely slide along the track 2, and upon which two electro-hydraulic movable, vertically adjustable horizontal cylinders 10 are mounted. Said transverse element 8 is moved by an electric ratiomotor (not shown) which acting on trolleys mounted on bearing wheels inserted into two opposite longitudinal sliding guides can be blocked due to a hydraulic braking device with two pistons (not shown). The possibility of positioning the horizontal movable pistons allows the concentration of the lateral deflection thrust on the points that can require such an action according to the specific situations.

All the mechanisms in the movable longitudinal transverse element 8 are controlled by a removable push-button panel 11 provided in the lower part of the tridimensional frame, and that can be used by the operator from any position desired.

The transversal movable elements 9 are made up of equipped tubular elements always sliding within the main track 2 (in this specific case along the upper wings of the beams, in such a way as not to be an obstacle to the free sliding of the longitudinal transverse element 8), wherein said tubular elements can be stopped in the desired position by a mechanical clamp blocking.

In the upper end of the tubular element, a hydraulic piston is provided (thrust between 200 and 2000 Kg), fixed on a support element 3 by a rack counter-bracket adjustable in height and that can be mechanically blocked.

The number of the transversal movable elements 9 is sufficient to guarantee in the positioning of the distance between centers a proper positioning of the components, in such a way to avoid that the spans between the different resting points can in anyway interfere (flexion stresses) with the proper positioning of the same. In the lower end of the transverse element a support element 14 delimiting the guided housing for the insertion of the lower longitudinal components of the structure to be assembled; the same function is performed by a containment template 15 (upper longitudinal components of the structure to be assembled).

In the following, the operation of the bed frame according to the invention will be described.

The first operation consists of the positioning of the longitudinal horizontal components of the structure (not shown): the bed frame is oriented in a horizontal position by the cylinders 5 and the upper and lower beams, suitably surface shaped, are then introduced bringing them in contact with the start abutment 4 (which in view of its particular shape correctly places the pieces in order to maintain the original offset).

Said upper and lower components form during this step a kind of track to contain the vertical components and provide means to structurally fix and bind them. In case due to external reasons with respect to the assembly step, said components should have very light linear deformations, the problem is solved by operating the pistons 12 mounted on the transverse elements, said piston thrusting the components up to bring them in contact with the relevant templates 15 making it possible to obtain again the design geometrical proper conformation; their cut off will occur during a following step in such a way to realize during the assembly a big chuck thus guaranteeing the fixed position of the components to each other in the different orientations of the bed frame.

Afterwards, the vertical components of the structure are introduced (also these components are now shown). As already said, the standard vertical components are inserted (according to what was previously determined in the architectural and executive design and schematized by graphic works divided for single modular bidimensional walls), starting from the first component that sliding along the track 2 abuts against the start abutment 4.

From now on all the other components can be rapidly introduced, said elements taking advantage from their morphologic features fit one in the other by a simple stacking mechanism, which does not allow the making of sequential assembling errors of any kind. During this step, the longitudinal movable transverse element 8 is used to help the single pieces slide one into the other, by a transverse pressure exerted by the two hydraulic pistons 10 that in view of their capability of sliding can be easily placed in the proper position to make such an operation on different profiles of the elements. Said pressing action is also useful to normalize the clearances in case due to outer agents the general dimension features are not kept with a high accuracy.

The possibility of making the longitudinal transverse element 8 move freely allows the making of a partial or total pressing action of the introduced vertical components, according to the dimensional and operative needs of the different equippable modular wall.

Then the partial fixing of the vertical and horizontal components is carried out, said elements being now under a double pressure thrust that does not allow any settling motion; therefore the partial fixing of the components can be carried out by self-blocking screwing, this operation making a first homogenization of the bearing structural system.

Now the passage of the plants is introduced. Once the structural and non-structural components are placed and fixed, the insertion within the previously established housing is carried out (said housings are inherent in the morphological conformation of the components), of the technical passages for the connection of the plants. They are realized in such a way to make any wall complete, as if they were part of the whole plant system, that at the moment of the quick coupling between the single parts is achieved as a logically thought out unitary complex (main feeding line); all the above is determined and described upward of said step in such a way to allow to the operators not skilled in the plant field, to follow a series of rationalized and elementary mounting operators that constitute the complex general system, but that if divided into single steps make the above operations very fast. Always within this step the general tightening components are housed in the proper housings; these last will be used also as connection points for the lifting and transportation cables since they are strategically placed along the bearing structural perimeter.

Then the final fixing can be executed, this step being the step of structural closure of the wall, during which the beams corresponding to the preceding ones are positioned, said beams closing the track-frame structure containing the vertical components and definitively fixing them. In this way a kind of H-shaped beam is structurally realized (having high flexural features), providing a technical inner passage space with the relevant maximum exploitation of the structural and non-structural encumbrance technical spaces. Said fixing occurs by a different screwing of special tightening elements (passing bars), characterizing also under an aesthetic point of view the equippable modular wall.

The finishing step, thanks to the possibility of easily orienting the entire working plan, is highly advantageous; in fact, the mounting of the total finishing components can be readily carried out. This operation is made still more simple by the use of the integrated tool system described in the foregoing, said system realizing a basic support for a fast and proper positioning of the various components. Always thanks to the bearing structure of the bed frame according to the invention, said operation allows to be executed simultaneously on two sides of the surface to be finished, in such a way that it is not necessary to carry out afterwards any further completion step, or when required to demand this operation to a subsequent step of the realizative process.

As far as the discharge is concerned, it must be remembered that the structural point portions comprising transverse pins provide the connection guided points for the lifting and positioning means. Said portions, being suitably position, allows one to maintain the resultants of the charges in a position such that it does not unbalance the weight of the wall and at the same time guarantees that the same finishing are not worn and abraded following to a bad interpretation by the operators of the calculation of the cables or similar temporary connection instruments passage points.

The strategic planimetric positioning within the general scheme of the productive cycle, permits that the bad frame is placed in a baricentric position conferring to the same the feature to be continuously aided by a mechanized overhead traveling crane, having the object of lifting and transporting the completed wall and at the same time allowing the fast positioning of components which would cause problems due to their weight, size and maneuverability to the operators in case they are manually positioned.

During the design search that brought to the realization of the machine according to the invention, it has always been kept well in mind, by the adoption of technical, organizational and procedural solutions, the problem connected with the reduction to a minimum value of the risks for the operators deriving from the exposition to noise due to the operation of mechanical means comprising the whole system.

The same attention has been given to the obtaining of the maximum simplicity of maneuverability of the machine, controlled by a push-button panel containing many graphic normalized symbols immediately perceivable, suitable to avoid that a wrong control even partially jeopardizes a procedural assembly sub-cycle.

Observing now FIGS. 3–17, the joint element according to the invention is shown, said joint comprising structural steel elements and many complementary workings for the housing on the wood structural elements.

The steel structural elements are preferably made up of galvanic zinc steel, having different morphological shaping and on which a series of different workings are realized at the workshop.

Figure 3:
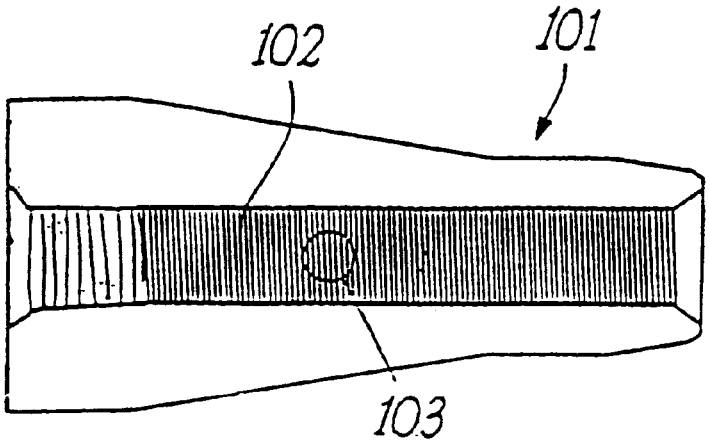
FIG. 3 shows the insertion pin of the joint element according to the invention.
Figure 4:
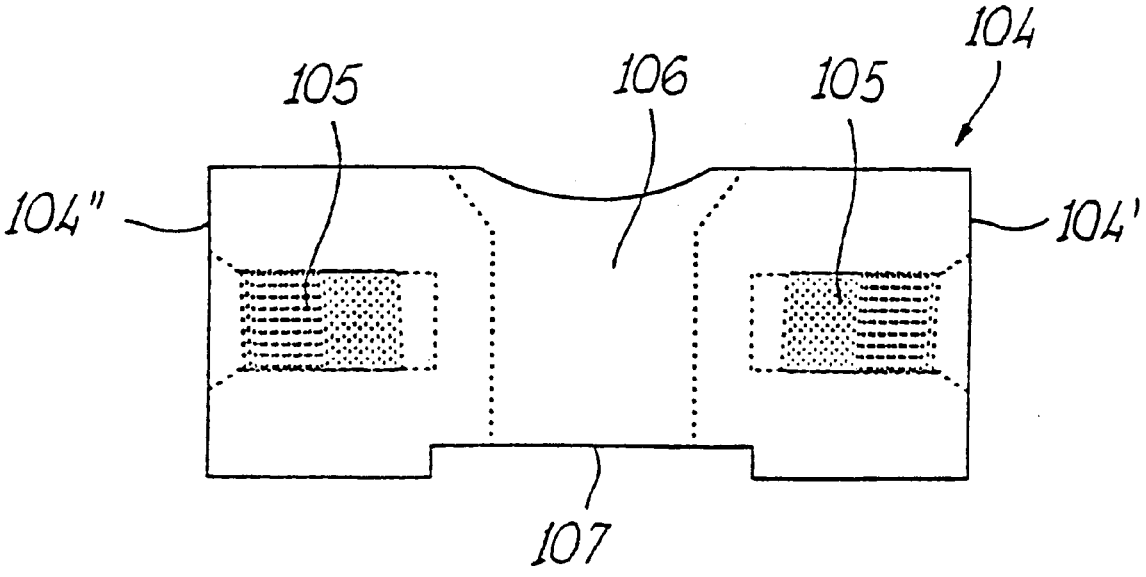
FIG. 4 shows the housing cylinder of the joint element according to the invention.

Observing particularly FIGS. 3 and 4, they comprise an insertion pin 101 (male) having a frusto-conical shape with a slightly tapered cylindrical upper part to facilitate the insertion and sliding operations.

Said pin provides an inner threaded passing-through hole 102 having the aim to connect on the head side 101' a tightening bolt (not shown) and on the tail side 101" the fixing threaded bar (not shown), to the housing cylinder (two, three or four ways joint) or to the wood structural components (wall coupling).

The outer surface of the pin 101 is completely smooth except for a blind hole 103 provided about at the middle of the total height and aimed to allow the insertion of a rod to facilitate the screwing of the pin 101 to the threaded bar.

This component is one of the two that up to now have been called "basic elements" since it has to perform many functions (housing, during the assembling, self-adjusting guide, tightening stud bolt etc.). The outer frusto-conical shaping is derived from the need for progressively blocking the motions of the joint elements, in such a way to allow the best positioning of the pin within the cylinder, with a relevant proper distribution of the deflection stresses along the contact surfaces.

In FIG. 4 the other component of the joint element according to the invention is shown, namely the housing cylinder 104 (female) made up of a simple cylinder upon which three different workings are present, respectively position on the basis and on the curved surface.

On the basis 104' and 104" a centered threaded hole 105 is realized said hole having a threaded inner surface, and within said hole bolts for the fixing on the wood components part (when it is used as tightening cylinder, see FIG. 5) or threaded bars (when it is used as joint element among steel components, see FIG. 6) can be introduced.

In a central position, a curbed surface is provided, in correspondence of said curve a passing through hole 106 is provided, said hole having on its two sides different workings, and more particularly on one side a housing surface cylindrical cut 107 for the nut introduced in the bolt, and on the other side a slot to facilitate the insertion of the pin head 101 and to realize a rest and bracing point for the walls during the field assembly.

Figure 5:
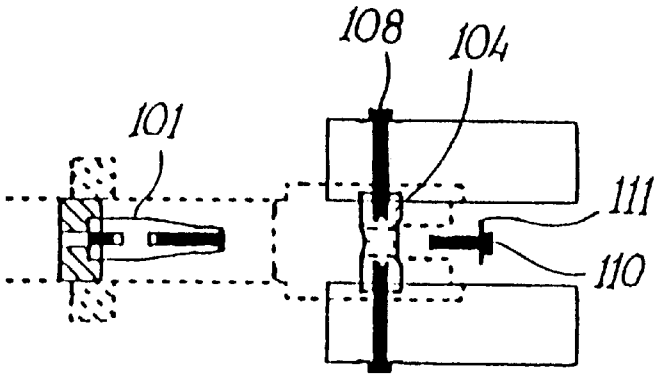
FIG. 5 shows a first use of the joint element according to the invention.

For the mounting of the joint element according to the invention an anchoring threaded bar 108 is used (see FIG. 5). It is a component performing three main tasks to fix the pin 101 or the steel cylinder 104 directly on the wood by a bolt and a nut for the distribution of loads (it is used for all the wall mounted cylinders 104, i.e., prepared beforehand to be inserted within the relevant pins 101 and in case of wall fixing, i.e., when the pin 101 and the bracket (not shown) are direct fixed on the beam); to be coupling element among the various steel components (in case of multiple ways joints); to tighten with a clamp action the wood components (in case of passing bar always provided close to the pins 101 or of the cylinders (in case of passing bar always provided close to the pins 101 or of the cylinders 104, since it tightens with a clamp action the ends of the beams containing the above mentioned components in order to improve their static features). Just by the contact between the wood components and the discontinuous surface of the threaded bar particularly interesting point has been put into evidence, so much so that in order to avoid shear stresses acting on the bar are transmitted to the inner surface of the housing holes, thus running the risk that the same holes are buckled, a retrieval has been adopted by which the threading treatment along the bars is interrupted each time said bars are in touch with the wood surfaces.

A tightening bolt 110 is then used, said bolt being the element that is introduced and screwed when the pin 101 (male) has already been introduced within the cylinder 104 (female); this element has the double task of tightening the components to each other and progressively dragging during the screwing action, to properly bring them in the definitive position.

The bolt 110 exerts its pressure on the cylinder 104 acting on the washer 111 for the distribution of the stresses, which is placed within the above mentioned surface cut, thus contributing to the proper and automatic positioning of the two base elements.

Figure 10:
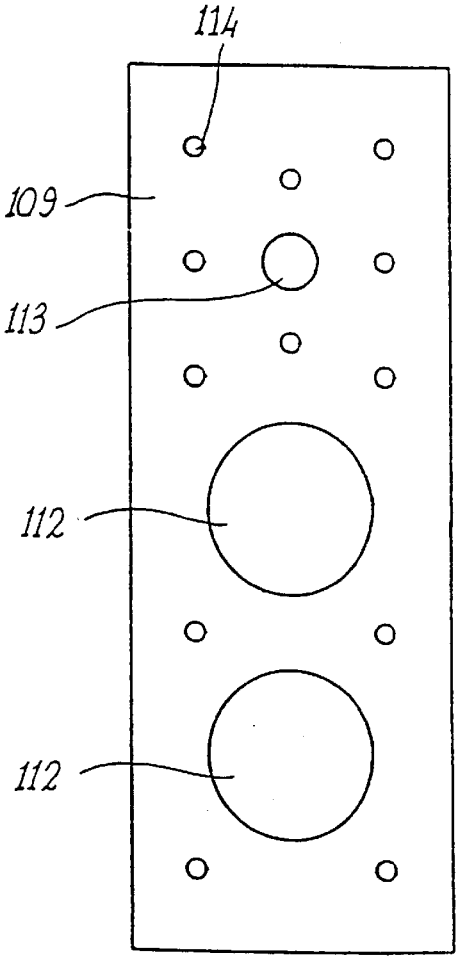
FIG. 10 shows a plan view of a plate to be used in particular with the solutions shown in FIGS. 8 and 9.

Referring now to FIG. 10, the wall coupling plate 109 is shown. While the steel elements described up to now are always taken into consideration for the realization of the different kind of joint, the wall coupling plate 109 is particularly used in the specific case of intermediate coupling of a secondary wall on a main wall, i.e., of the direct fixing on the bearing beams. Its main function is that of distributing the torsion loads acting on the wood beams, in such a way to avoid that the direct action of the pin base on the cut surface of the beam creates a tearing action of the wood fibers with the consequent jeopardizing of the flexion resistance features of the beam and bad tightening of the joint. The plate 109 is comprised of a steel flat plate suitably holed according to three main criteria:

- two holes 112 having a big size and axially aligned with each other and having two different functions, namely either for the passage of the canalizations of the technical plants and for housing the base of the insertion pin;
- a hole 113 having a middle size and axially aligned with the two bigger holes and performing the sole function of passage of the passing through threaded bar, used as already described for the optimization of the static response of the joint assembly;
- holes 114 having little dimensions suitably positioned and provided in a sufficient number to guarantee the introduction of a series of self-plugging screws in order to obtain a homogenous fixing between the plate and beam surfaces, with the relevant improvement of the static response.

For the integration of the joint element according to the invention with the prefabrication system set by the Applicant, suitable complementary housing workings have been provided on the wood structural elements, said workings not being part of the present invention.

In the enclosed figures some possible use of the joint element according to the present invention are shown, demonstrating the maximum flexibility and simplicity.

The assembly of components and workings comprising the joint element according to the invention is present in the prefabrication system of the Applicant in the equipped bidimensional modular walls, in a strategic position close to the angular surfaces of any single wall, with a turnover with respect to an axis, depending on the upper or lower position assumed (i.e. close to the roof or to the floor) (FIGS. 4, 5, 6).

For illustrative purposes the utilization steps of the joint element according to the invention will be described.

The joint element arrives to the field divided into two parts respectively mounted on the upper and lower end of the angular component of the secondary wall that hooks (female housing cylinder 104), and on the pillar contained in the main wall which hooks (insertion pin 101). The steps of assembling and tightening of the joint with the field can be so summarized.

1) Positioning of the Wall: each single wall arrives at the field completely finished and ready for the hooking. The transfer operation from the transport means used to the final seat occurs employing lifting and positioning wires which place the same close to the corresponding hooking. Said wires are connected during this step to the joints in such a way to avoid jeopardizing the aesthetic features and guaranteeing the proper lifting of the baricentric axis of the wall, in such a way not to cause settling unbalancing;

2) Self-insertion of the pin 101: during this step, the big dimensions of the wall can create maneuverability problems, with the consequent difficulties of insertion of the pins 101 within the already mounted cylinders 104. In order to facilitate such operation, a series of particular conformations of the surface of the components have been thought, said solutions guaranteeing an immediate and progressive introduction in the proper position of the pin 101 and the contemporaneous execution of the bracing function of the wall;

3) Insertion and screwing of the bolt 110, important time under two aspects: one is that of allowing the proper perpendicular positioning of the walls since it is impossible to erroneously mount the components, creating "out of position" situations, the other one is that of dragging up to obtain a perfect surface contact with the outer surface of the wall, intrinsically acting as a positioning jack;

4) Tightening by a dynamometric key: while the other assembling steps can go on without temporary obstacles, the definitive tightening of the bolt 110 is realized forcing that the deflection stresses induced are not casually created, but instead they are established in a precise way. This fact guarantees that the global static response of the structures is the one calculated to easily absorb determined tension stress levels and can be obtained thanks to a special tightening key provided with a dynamometer, which is used by the workers in charge of the mounting operation introducing the same into the suitable boxes provided for this operation close to each the hooking of a joint.

As it has been possible to observe, the assembling and tightening steps have been rationalized thanks to the use of the joint element according to the invention, in such a way to carry out by a simple work, many secondary operations realized in an unconscious and unconditional way each time the positioning and the screwing of the pin and of the joint is carried out.

It can happen following to a landslide of the foundation ground or for other outer reasons that relevant movement of the resting points occur, with the consequent tension overcharge in determined points and equivalent relief in other points; in these cases it is possible to act again on the bolt 110 in any moment without breaking of material removal, thanks to the screwing boxes which performing also the inspection point and plant connection task, are closed by easily removable plates.

In FIGS. 8, 9, 10 and 11 a horizontal joint is shown having one, two, three or four ways: these are the kind of joints usually employed in the multi-directional joints, in case many primary and secondary walls converge in determined points, thus creating complex structural situations.

In FIG. 15 a wall horizontal joint is shown: it is a kind of coupling wherein a secondary wall can be coupled by head with a primary wall in any intermediate point of the latter even if a pillar is not provided, using the wall coupling plate component directly mounted on the upper and lower beams; the one shown in FIG. 16 is a vertical joint: for the superposition of two walls to realize buildings having many planes the same kind of joint is used but it is turned over of 90° and using a modification. A cylinder is introduced transversely within the thickness of a beam having the aim of connecting two walls, said cylinder will be fixed within the upper side by a bolt, disappeared within the cut in the wood, on a threaded bar, instead in the lower part is blocked by a bolt blocked on the transverse cylinder contained in the beam of the lower part.

The sole particularity of the vertical hooking is due to its position slightly behind with respect to the outer edge of the wall, thus preventing that the latter is overlapped in the same point where the horizontal coupling is positioned.

Finally, in FIG. 17 a cantilevered joint is shown: it is a kind of particular coupling that is used in determined cases when cantilevered couplings are desired without the need of using a continued beam, but making the plane working under a torsion stress on an outer beam, for example in case of little cantilevered covers. Its realization is demanded to a double introduction pin on the coupling beam and some housing cylinders on the head of the cantilevered beams.

A joint element as the one proposed according to the present invention provides in any kind of application many general advantages, namely:

facilitation of the proper positioning of the elements to be assembled. Due to the particular morphological features of the components of the joint elements, the numerous steps of positioning and calibration necessary for a proper assembling of more elements have been dramatically reduced to only one elementary operation comprising the positioning of the insertion pin mounted on a component close to the housing cylinder positioned on the other one, allowing the temporary settling of the positioning movements during use, while at the same time maintaining a sufficient flexibility limit for the following final tightening steps;

simplification of the tightening operations, one placed adjacent, the two base elements have the initial tapered part of the introduction pin (a detailed morphological description will be given in the following), already placed within a pre-housing slot; these facts allow the reduction of the pre-tightening operations, simply screwing the head of the insertion pin, of the "tightening bolt" passing through the cut of the housing cylinder. Going on with the simple screwing of the bolt, the tightening is completed at the same time and automatically calibrating, the only of the possible axial positions wished and imposed to the base components, i.e., the orthogonal one;

tightening behavior similar to a returning jack: for the execution of the above mentioned step usually in the coupling systems having this feature common with the following outer means (jacks, winches, clamps etc.) were used to facilitate the complete contact between the components parts to be tightened. By the solution according to the invention the use of other tools have been completely eliminated, but the tools necessary for the screwing, since the only motion to be exerted during the settling of the components is the axial sliding that is automatically satisfied at the time of the tightening of the bolt. The clearances between the two components can be modified on the basis of the different sections and in any case guarantee that the stresses during the tightening and returning steps of the pieces are uniformly distributed on the contract surfaces in such a way as not to jeopardize the integrity of the joint by occasional permanent strains;

flexibility of the coupling of more than one inclination axis. This remarkable advantage is due to the fact that with only one kind of joint, it is possible to realize different compositions, from the simple coupling (T coupling) to the one with four ways (cross coupling), from the intermediate coupling, to a vertical or cantilevered coupling. Obviously, precise positioning relationships correspond to the different hypotheses, said relationships realizing the "coupling system", without modifying the shape and the dimensions, but only their number and the respective positioning;

possibility of adjusting the same during the assembly by skilled labor. Seemingly, such a complicated locking system could make one erroneously think that to be mounted at the field very skilled and prepared labor would be necessary, idea that is opposite to the idea which is the basis of the design search looked for and of the final realization obtained. In fact, by having limited the tightening operation to the simple screwing of a bolt and having shaped the joint surfaces, on the basis of the experience developed during the field practice, in such a way to provide in established operative moments a substantial help to overcome eventual objective difficulties cyclically, it has been individuated the way of allowing also to unskilled labor occasionally recruited, to assemble several structural parts without the need of an extemporaneous interpretation or idea for any kind of the constructive procedures, since the only possibility given is the consequence of all the possible and conceivable solutions for the specific problem. To this end, it has been provided the design of a particular kind of tool (dynamometric key with jack which does not make part of the present invention), which allows the contemporaneous ergonomic optimization of the screwing motion and the contemporaneous pre-tensioning calibration of the tension stress of the bolt;

it does not require the use of further coupling elements: once the bolt has been tightened with the proper strength, it can be said that the assembly procedures of the components of the joint have been completed. In fact, no further step is required for the tightening or locking with any kind of tightening element, since all the work is carried out in a proper and exhaustive way by the capability of squeezing each other by a clamp action of the two main components of the joint, which taking advantage of the inner friction stresses lock any possible occasional motion;

possibility of being properly calibrated again also when the assembling process is finished. In all the known constructive systems, once the fixed joint among many structural components has been realized, it is absolutely impossible to act again on the joint points without the risk of jeopardizing the features of static stability of the whole bearing structural systems. Such a limit is very important in view of the fact that both during the period of the building process at the field and in a following moment of the life cycle of the final building product, structural settling phenomenons could occur due to outer agents (settling of the ground relative bearing, seismic stress, different dynamic actions, etc.). This kind of joint has been conceived also to be able to allow to simply, quickly and mainly without jeopardizing the static-aesthetic features of the structures, arrive to a possible continuous hypothetical control of the proper tension level of the bearing structural elements.

Before describing in detail the enclosed FIG. 18, it must be pointed out that the solution shown is only one of the infinite possible combinations that could be realized by the solution according to the present invention, and therefore it must not be considered limitative of the invention.

The wall according to the invention provides an upper beam 201 and a lower beam 202.

The two beams 201 and 202 are each comprised of two longitudinal members, respectively indicated by the reference numbers 203 and 204, and 205 and 206, parallel and spaced apart from each other by spacers (not shown), in such a way to form a track.

Between said longitudinal elements 203, 204 and 205, 206 the vertical elements are inserted, said elements completing the wall.

In the figure, there is a pillar 207, a window 208, a full wall 209 and an angular components 210, but it is well evident that the structuring of the wall according to the invention allows the formation of any kind of combination.

The beams 201 and 202 are then provided with shunt boxes 211, for the electrical, hydraulic and other types of connections, as well as joint elements, that could be, for example, those described in the above.

The upper 201 and lower 202 main beam (track) structurally make up a sole body with the vertical elements (207,208,209,210) (standard components), and the connection obtained by bolting allows to consider said fixings as hinge points within the system.

Being such an assembly provided longitudinally with its own stiffness, it can be particularly suitable to take over the horizontal actions, either due to a seismic event, to the wind or to other factors and to transmit them again to the underlying support elements by suitable connection metallic brackets (now shown).

The transverse stiffness of any beam-wall is ensured by the other walls provided transversely with respect to the one taken into consideration and by the "plate" effect due to the floors.

To the standard vertical components the double function of absorbing the vertical loads transmitted by the roofs and of transverse bracing is ascribed.

Besides the outer and inner flexibility feature of the wall, the latter is characterized by other particular features, such as the fact that it is completed with finishings and plants at the moment it comes from the serial assembling factory, the ease of assembly at the field because of the surface solutions being arranged beforehand, and finally, the ease in transporting the assembled elements.

The innovation with respect to the prior art is not the decomposition of the main structural system into simple bidimensional elements (fact that can be already found in the prefabricated building field), but rather is the conception of an aggregative structural model that besides guaranteeing infinite possibilities of compositive solutions, does not clearly define a distinction between the bearing, plugging and finishing structures, but is entrusted to a synergistic work among all the elements comprising a wall.

On the particular vertical section of the beams (upper 201 and lower 202) having an H shape, a long work was done to optimize the technical spaces relevant to the passages of the plants that usually require suitable housings (false ceiling, cavities between walls, etc.), which occupy parts of habitable space; the qualitative jump has been obtained when, starting from a shape optimizing the flexion resistance features, the above mentioned spaces have been obtained, thus reaching a double result: the one of not needing further spaces to be deducted from the habitable one and the one of allowing that the connection of the peripheral elements (connection to the sockets, switches, fancoil) with the main branches passing through the beams occurs completely within the structural elements, without the need to use outer channels or aesthetic "cover" solutions.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. An apparatus for the assembly of modular equippable walls providing a multi-equipped bed frame having an adjustable positioning, said bed frame comprising:

a base plane (1);

a support frame, hinged to said base plane (1) in such a way to be able to take any orientation from horizontal to vertical, with respect to said plane;

a longitudinal track element (2) provided integral with said support frame;

a counter-shape or start abutment (4) provided at one end of said track element (2);

a movable transverse element (8) for sliding longitudinal adjustment along said track element (2); and a plurality of movable transverse elements (9) for transversal adjustment, movable along said track element (2).

2. An apparatus according to claim 1, further comprising a tool supporting element or castle (7).

3. An apparatus according to claim 1, wherein said support frame is movable by electro-hydraulic pistons (5).

4. An apparatus according to claim 3, wherein said plane (1) is positioned in such a way to allow the disappearance of the electro-hydraulic pistons (5).

5. An apparatus according to claim 2, wherein said tool supporting element or castle (7) comprises containers and electric and pneumatic connections with tube winders.

6. An apparatus according to claim 1, wherein said movable transverse element (8) for the longitudinal adjustment comprises a C-shaped tridimensional frame.

7. An apparatus according to claim 1, wherein said movable transverse element (8) for the longitudinal regulation comprises two vertically adjustable horizontal electro-hydraulic movable cylinders (10), operated by a ratiomotor and slidable along opposite longitudinal sliding guides.

8. An apparatus according to claim 1, wherein said movable transverse element (8) for the longitudinal regulation comprises a control movable push-button (11).

9. An apparatus according to claim 1, wherein said movable transverse elements (9) for the transverse adjustment comprise equipped tubular elements, wherein said equipped tubular elements slide along said track element (2).

10. An apparatus according to claim 9, wherein said movable transverse elements (9) are stopped in the desired position by a mechanical clamping.

11. An apparatus according to claim 9, wherein a hydraulic piston is mounted in the upper end of the tubular element, and said hydraulic piston is fixed by a support with a height adjustable counter-bracket.

12. An apparatus according to claim 9, wherein the number of movable transverse elements (9) for the transversal adjustment is chosen in such a way to be sufficient to guarantee the mutual disposition of the distance between centers, and a proper positioning of components supported by said transverse elements, so as to avoid that the distance between different resting points interfere in any way with a proper positioning of the components.

13. An apparatus according to claim 1, wherein in the lower end of the transverse element, a support square (14) is fixed, said square (14) defining the guided housing for the insertion of the lower longitudinal components of the structure to be assembled; the same function is performed on the other end by a containment template for the upper longitudinal components of the structure to be assembled.

14. An apparatus according to claim 1, wherein said track element (2) comprises two steel channels joined together by slanting crossed tubes.

15. An apparatus according to claim 1, wherein said apparatus comprises joint elements for the facilitated composite assembling comprising a substantially frusto-conical shaped insertion pin male element (101) having a central through hole (102), and a housing female element (104) having a central through hole (106) for the insertion of said male element (101), and said female element also having two threaded blind transverse holes (105).

16. An apparatus according to claim 15, wherein said male element (101) and said female element (104) are made up of galvanized zinc steel.

17. An apparatus according to claim 15, wherein said male element (101) comprises a blind transverse hole (103) for the coupling of a tightening tool.

18. An apparatus according to claim 15, wherein said male element (101) comprises a slightly tapered cylindrical front portion to facilitate the insertion within said central through hole of said female element (104).

19. An apparatus according to claim 15, wherein the outer surface of said male element (101) is completely smooth.

20. An apparatus according to claim 15, wherein said female element (104) of the joint element provides on two sides with respect to the central through hole (105) a surface cylindrical recess (106) for the housing of a tightening element and a slot (107) for facilitating the introduction of the male element (101), respectively.

21. An apparatus according to claim 15, further comprising a plate (109) between a fixing element and the wall.

22. An apparatus according to claim 1, comprising modular equippable walls, said walls comprising an upper beam (201) and a lower beam (202), each beam (201, 202) comprising a pair of longitudinal elements (203, 204; 205, 206) disposed parallel to each other, and said upper beam (201) and lower beam (202) forming a double track structure for the introduction of vertical elements (207, 208, 209, 210) for the completion of the wall.

23. An apparatus according to claim 22, wherein said pair of longitudinal elements (203, 204; 205, 206) of said upper (201) and lower beams (202) are separated and kept parallel to each other by spacer elements.

24. An apparatus according to claim 22, wherein said upper (201) and lower beams (202) are provided with passages for cables and/or tubes, shunt boxes (211).

25. An apparatus according to claim 22, wherein said wall is coupled with a further prosecution or corner wall by suitable coupling means.

26. An apparatus according to claim 22, wherein said vertical elements (207, 208, 209, 210) for the completion of the wall are of any kind of structure, wherein said vertical elements are introduced in the track structure and fixed by suitable means.

27. A method for prefabricating civil and industrial buildings having complete equippable modular walls, having a wood bearing structure, comprising:

examination of an architectural design;

transfer of design information concerning said architectural design to a computer;

dividing the information concerning said architectural design into complete modular wall elements with plugging, finishing, and plants;

determining structural components, finishings, accessories, plants for each modular wall element and mutual positions and couplings of said structural components, finishings, accessories, plants;

determining modular wall subcomponent designs which comprise structural elements and non-structural elements, with said structural elements of said subcomponent designs being designed for factory combining in side-to-side stacked fashion so as to form structurally complete, individual modular wall elements, and said modular wall subcomponent designs including plugging, finishing and plant elements that are positioned for relative system interconnection upon said structural elements being combined to form respective, complete individual wall elements.

28. The method of claim 27, further comprising forming said structural elements of said subcomponent designs, providing said non-structural elements and assembling in the factory said structural elements and said non-structural elements, with said structural elements being placed in stacked side-to-side contact to form said individual wall elements.

29. The method of claim 28, wherein said individual modular wall elements include a track element, and said structural elements slide within said track element while being stacked in side-to-side contact.

30. The method of claim 28, wherein said individual modular wall elements include an upper and a lower track element, and said structural elements slide within said upper and lower track elements while being stacked in side-to-side contact, and said non-structural elements including plant elements are positioned within said track and between an inserted edge of an inserted structural element during structural element stacking.

31. The method of claim 29, further comprising transferring said individual wall elements to a field location and assembling said wall elements with joint elements which joint elements include a substantially frusto-conical shaped insertion pin male element and a housing female element having a central through-hole for the reception of said male element and two threaded blind transverse holes.

32. The method of claim 28, wherein forming said structural elements includes forming all of said structural elements of resin impregnated conifer lamellar wood.

33. The method of claim 27, wherein a determining of modular wall subcomponent designs includes defining structural elements that are stacked solely in a side-to-side arrangement during modular wall element formation and also defining structural elements that are stacked both in a side-to-side arrangement and an above-below arrangement with respect to adjacent structural elements.

* * * * *